US005622027A

United States Patent [19]

Staub et al.

[11] Patent Number: 5,622,027

[45] Date of Patent: Apr. 22, 1997

[54] COILING APPARATUS FOR FLEXIBLE PLANAR ARTICLES AND METHOD FOR THE COILING UP OF FLEXIBLE PLANAR ARTICLES

[75] Inventors: Samuel Staub, Oberdurnten; Peter Hausmann, Baretswil, both of Switzerland

[73] Assignee: Ferag AG, Switzerland

[21] Appl. No.: 326,090

[22] Filed: Oct. 19, 1994

[30] Foreign Application Priority Data

Nov. 8, 1993 [CH] Switzerland ..... 03366/93

[51] Int. Cl.[6] ..... B65B 63/04

[52] U.S. Cl. ..... 53/118; 53/119; 53/528

[58] Field of Search ..... 242/528, 546, 242/351; 53/118, 119

[56] References Cited

U.S. PATENT DOCUMENTS

| | | | |
|---|---|---|---|
| 2,996,264 | 8/1961 | Bygdnes | 242/351 |
| 3,528,627 | 9/1970 | Sindlinger | 242/351 X |
| 3,690,590 | 9/1972 | Bennett et al. | 242/351 X |
| 3,968,941 | 7/1976 | Catto | 242/351 |
| 4,145,016 | 3/1979 | Wiig | 242/351 |
| 4,438,618 | 3/1984 | Honegger . | |
| 4,842,215 | 6/1989 | Takami | 242/546 X |
| 4,866,910 | 9/1989 | Reist | 53/118 X |
| 4,871,125 | 10/1989 | Haueter | 53/118 X |

FOREIGN PATENT DOCUMENTS

| | | |
|---|---|---|
| 3123888 | 6/1981 | Germany . |
| 2081230 | 7/1981 | United Kingdom . |

*Primary Examiner*—Daniel Moon
*Attorney, Agent, or Firm*—Brinks Hofer Gilson & Lione

[57] ABSTRACT

The coiling apparatus for flexible planar articles (44), in particular printed products such as newspapers, magazines and parts thereof comprises a winding core (16), which is rotatably journalled in a frame (12) and drivable by a drive shaft (28), and a coiling band (24) which directs the flexible planar articles (44) essentially tangentially to the coiling core and is wound up onto the coiling core together with the planar articles. A drive train comprising a driving disc (38), a drive belt (40) and a drive belt disc (42) makes it possible to rotate the shaft (14) on which the winding core (16) is rotatably mounted from the same motor as drives the band reel (26). Between the winding core (16) and the rotary shaft (14) there is located a spiral spring (18) which is secured at its one end (20) to the winding core and at its other end (22) to the rotary shaft (14). The arrangement is so devised that the end (22) of the spring (18) can be moved relative to the spring end (20) in order to change the state of tension of the spring. The apparatus makes it possible in this manner to adapt the torque exerted onto the coiling core to the increasing coil diameter during winding up of the coiling band (24) with the planar articles (44). A regulating system is not necessary.

41 Claims, 5 Drawing Sheets

COILING APPARATUS FOR FLEXIBLE PLANAR ARTICLES AND METHOD FOR THE COILING UP OF FLEXIBLE PLANAR ARTICLES

FIELD OF THE INVENTION

The present invention relates to a coiling apparatus for flexible planar articles, in particular printed products such as newspapers, magazines and parts thereof, the apparatus comprising a winding core which is rotatably journalled in a frame and drivable by a drive shaft, and at least one coiling band which directs the flexible planar articles at least substantially tangentially to the winding core and which comes from a band reel and can be wound together with the planar articles onto the winding core.

BRIEF DESCRIPTION OF THE PRIOR ART

A coiling apparatus of this kind is known from the German patent specification 31 23 888 and from the corresponding U.S. Pat. No. 4,438,618.

The coiling apparatus of DE-PS 31 23 888 is in particular provided for the winding up of a so-called imbricated formation consisting of folded newspapers or parts thereof which are placed on top of one another in an overlapping arrangement resembling a roof tile formation and which, for the purpose of transport within a printing works and from one printing works to another, are wound up in space-saving manner in a compact coil on the winding core. At the destination the coiling band is wound off from the coil again, together with the imbricated formation, and the individual newspapers or parts thereof are then available for further processing.

A coiling apparatus of this kind is however not exclusively intended for such an overlapping formation of newspapers, but can rather serve for the most diverse purposes, for example for rolling up articles as different as bank notes, sacks and lengths of veneer, to name only a few examples.

In DE-PS 31 23 888 which is concerned in particular with the winding up of an overlapping formation of newspapers a motor is provided as a drive source which drives the winding core via a coiling transmission. The coiling band which engages beneath the material and is connected to the winding core is guided over a deflection roller driven by a motor during the winding up onto the winding core and is hereby unwound at constant speed from a band reel which is freely rotatably journalled about its axle of rotation. A shoe brake however engages with this band reel.

The aim is to keep the tension in the coiling band at least approximately constant. This means that with an increasing diameter of the coil an increased torque must be exerted on the winding core by the drive, and indeed with a reducing speed of rotation of the coil, since one also wishes to keep the circumferential speed of the coil, i.e. the linear speed of the coiling band at least substantially constant. This requirement for constant speed of the coiling band with at least substantially constant tension requires in practice a not insubstantial degree of complexity and expense in the regulated drive, and also for the driven deflection roll and the shoe brake.

PRINCIPAL OBJECT OF THE INVENTION

The object of the present invention is to provide an apparatus of simple design for the manufacture of coils which does not require any complicated mechanical system or regulation system and which is nevertheless suitable, up to a restricted coiling capacity dependent on the layout of the apparatus, for ensuring a satisfactory winding up of the material to be coiled and also a problemfree uncoiling of the latter.

BRIEF SUMMARY OF THE INVENTION

In order to satisfy this object provision is made apparatuswise, that the band reel is rotationally fixedly arranged on the drive shaft; that the drive shaft is coupled with the winding core not only via the coiling band and the band reel but rather also via a drive train; and that a spring having two ends, which execute a relative movement to one another in operation, is provided in the drive train between the band reel and the winding core.

This fundamentally new concept can be relatively quickly explained in more detail with reference to a practical embodiment in which the spring is a spiral spring, a drive spring or a torsion spring having a plurality of coils.

For the sake of simplification it is first assumed, in a manner which can also be entirely realised in a practical embodiment, that the one end of the spring is connected to the winding core and the other end is secured to a rotatable shaft which is rotatable from the drive train in order to influence the state of tension of the spring.

It is now assumed that the spring is in a partially tensioned state, i.e. is pretensioned, as a result of the installation conditions.

As soon as the flexible planar articles are available for winding onto the winding core the winding up work can be commenced. The coiling band is given up by the band reel through rotation of the drive shaft in the corresponding direction of rotation. The partly tensioned spring has, as a result, the possibility of relaxing further and winds the coiling band together with the flexible planar articles to be coiled up onto the winding core. In this way the potential energy stored in the spring is converted, at least in part, into coiling work. A relaxation of the spring tension during the winding up of the coiling band onto the winding core is prevented in as much as the rotatable shaft moves the other spring end via the drive train in the sense of increasing the spring tension. In other words the spring is more strongly tensioned by the drive train than it is relaxed by the coiling up of the coiling band. Thus the torque acting on the winding core increases with the tensioning of the spring, whereby the torque is matched to the increasing diameter of the winding core with the flexible articles coiled thereon, whereby the tension in the coiling band remains at least approximately constant.

During the unwinding of the coiling band from the winding core by the band reel driven from the drive source not only is the first end of the spring moved in a direction which increases the spring tension, but rather the other end of the spring is moved from the same drive source via the drive train in the sense of relaxing the spring tension via the drive train until one has reached the starting state again.

During the unwinding of printed products it is desirable to keep the tension in the coiling band constant within certain limits during the entire winding procedure. This signifies that as the diameter of the coil increases an increasing torque is necessary to rotate the winding core and this can, as has been explained above, be realised by means of the drive train and the spring. The entire coiling apparatus can in practice be manufactured relatively economically, particularly since the same drive source serves both for the rotation of the band reel and also for the driving of the drive train, for example by rotation of a driving disc of the latter. Since both the band reel and also the driving disc can be arranged on the same drive shaft a saving of additional parts is entirely possible. In total few parts are required in order to realise the coiling apparatus of the invention. Any kind of complicated control is unnecessary.

Although the spring is preferably arranged in space-saving manner in the winding core it can however also be arranged between the band reel and the drive train, with the drive shaft driving the driving disc of the drive train directly and the band reel indirectly via the spring. With embodiments of this kind the drive train is rotationally fixedly coupled to the winding core.

Particularly preferred embodiments of the coiling apparatus of the invention can be found from the dependent claims. The present invention can also be viewed as a coiling apparatus for flexible planar articles, in particular printed products such as newspapers, magazines and parts thereof, the apparatus comprising a frame, a winding core which is rotatably journalled in said frame, a drive shaft for driving said winding core, a band reel coupled to said drive shaft, and at least one coiling band which directs the flexible planar articles at least substantially tangentially to said winding core and which comes from said band reel and can be wound together with the planar articles onto the winding core, wherein said drive shaft is coupled to said winding core not only via said band reel and said coiling band but also via a drive train; wherein said coiling band is tensioned both prior to and also during the winding up onto said winding core and during the winding off from said winding core, and thus exerts a first torque on the latter; wherein said drive shaft exerts via said drive train a second torque on said winding core opposed to said first torque; and wherein a spring is provided which modifies the relative sizes of the first and second torques, i.e. the size of the differential torque during the winding up and unwinding of said coiling band, in the sense of an adaptation to the coiling process. All these embodiments have in common that one needs only one drive motor in order to achieve the unwinding of the winding band from the winding core, and the winding up of the winding band onto the winding core. The regulation of the coiling apparatus takes place automatically through the layout of the spring and also of the further components. Although a single coil spring has been illustrated, it is contemplated that a plurality of springs could be used that operate in parallel or in series with each other. It is also contemplated that an arresting means could be provided to prevent undesired rotation of the winding core.

The invention can also be realised in a coiling apparatus which is of modular- or cassette-like form. In an example of this kind the frame can simply carry a drive shaft which can be driven from an external drive source on docking of the module onto this drive source.

BRIEF DESCRIPTION OF THE DRAWINGS

The invention will subsequently be explained in more detail with reference to embodiments and to the drawings in which are shown.

DETAILED DESCRIPTION OF PREFERRED EMBOBDIMENTS

Figure 1:
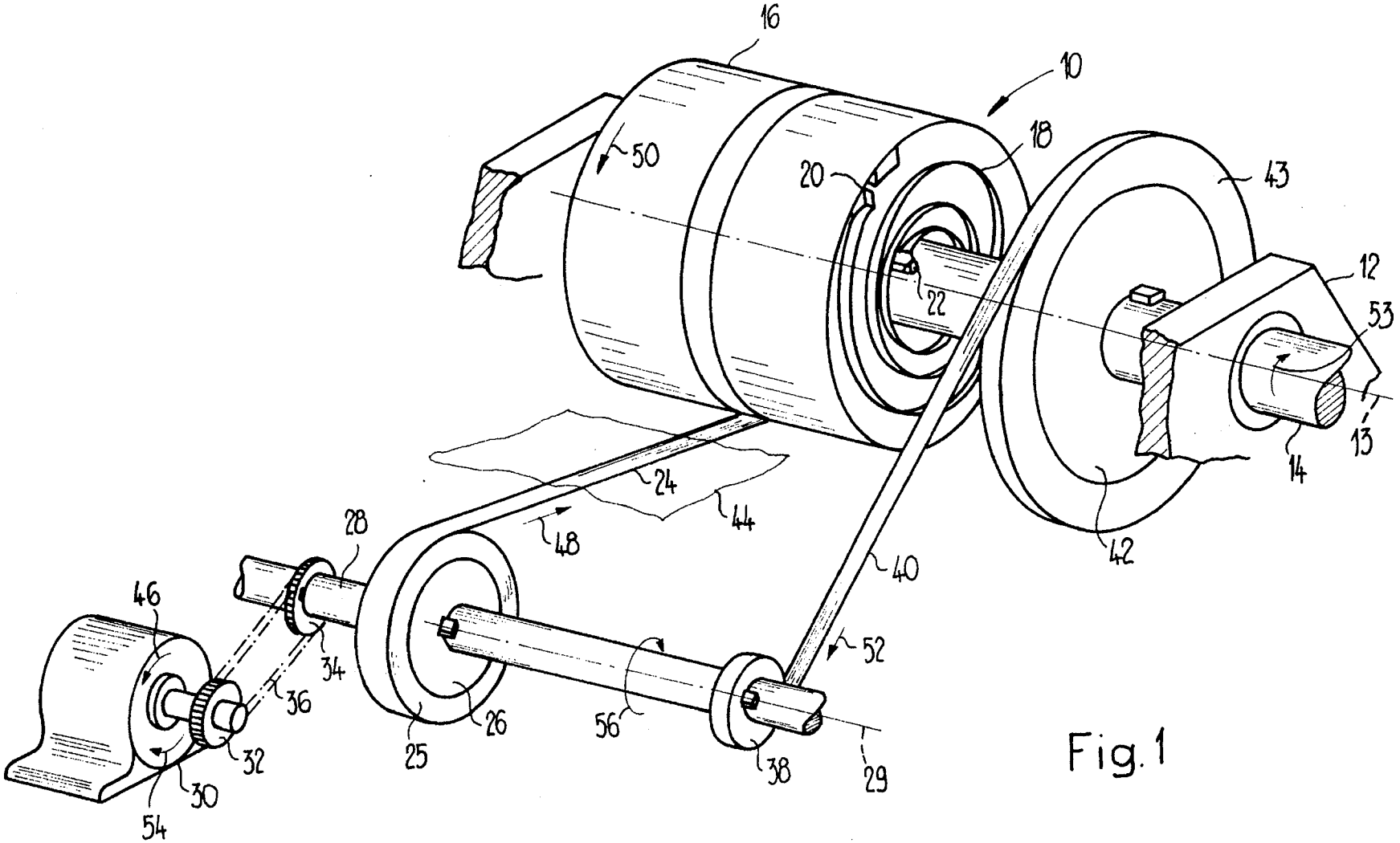
FIG. 1 a highly schematic perspective illustration of a preferred practical embodiment of a coiling apparatus in accordance with the invention, FIGS. 2A, B and C sketches to explain the starting state of the apparatus of FIG. 1 before the flexible planar articles are wound with the coiling band onto the winding core, with FIG. 2B showing the conditions for the coiling band and FIG. 2C showing the conditions for the drive train, FIGS. 3A, B and C are sketches similar to those of FIGS. 2A, B and C but after the flexible planar articles have been coiled up with the coiling band onto the winding core, FIG. 4 a schematic illustration of a variant of the coiling apparatus of the invention as seen from the end face of the winding core in which the drive train includes a drive belt which is wound up and unwound, FIG. 5 a schematic illustration similar to FIG. 4 but of a further variant of a coiling apparatus in accordance with the invention, FIG. 6 a schematic illustration similar to FIGS. 4 and 5 but of a coiling apparatus in accordance with the invention in which the drive train includes an endless recirculating drive belt or a drive chain, FIG. 7 a further variant of a coiling apparatus in accordance with the invention in which the spring is inserted between the band reel and a spur gear of the drive train, FIG. 8 a graphic illustration of the changing torque exerted by the spring on the winding core for an embodiment of a coiling apparatus in accordance with the invention, FIG. 9 a graphic illustration in accordance with FIG. 8 but of a further embodiment of a coiling apparatus in accordance with the invention.

In all figures the same reference numerals refer to like components.

In accordance with FIG. 1 the coiling apparatus 10 comprises a frame 12 in which there is journalled a shaft 14 rotatable about the axis 13, with a drum-like winding core or mandrel 16 being rotatably journalled on the rotary shaft 14 in bearings (not shown), which are for example arranged at the end faces of the drum. Between the winding core 16 and the rotatable shaft 14 there is located a spiral spring 18 the one end 20 of which is fixedly coupled to the winding core 16 and the other end 22 of which is fixedly coupled to the rotatable shaft 14.

A coiling band 24 which is connected to the winding core 16 extends from the winding core 16 to a band reel 26 which is rotationally fixedly connected to a drive shaft 28. The drive shaft 28 can be driven by a motor 30 via toothed wheels 32, 34 and a toothed belt or a chain 36, whereby the shaft 28, or the motor 30, represents the drive source for the band reel 26. The drive shaft 28 which extends parallel to the rotary shaft 14 and is arranged alongside the winding core also carries a driving disc 38 at an axial distance from the band reel 26 and the driving disc is likewise rotationally fixedly connected to the drive shaft 28. It serves for the winding up and unwinding of a drive belt 40 which extends from the driving disc 38 to a drive belt disc 42 which is rotationally fixedly coupled to the rotary shaft 14. The motor 30 can either be fixedly installed in the frame (and optionally drive the shaft 28 directly) or can be arranged outside of the frame 12 separate from the latter.

The schematic illustration of FIG. 1 shows the starting position before the flexible printed products such as newspapers, magazines and parts of the like, of which one is shown at 44 are wound up with the coiling band 24 onto the winding core. The flexible planar articles are then supplied to the coiling band 24 by means of a suitable supply device (not shown). One sees from FIG. 1 that the coiling band 24 is wound up onto the band reel 26 so that a coil 25 of the coiling band is present which has its maximum diameter at the start of the coiling up procedure.

The drive belt 40 is in contrast practically fully wound up onto the drive belt disc 42, i.e. it is not wound up to any notable extent onto the driving disc 38 but only by as much as is necessary in order to ensure a secure anchoring of the one end of the drive belt 40 to the driving disc 38. A coil 43 of the drive belt 40 is thus located on the drive belt disc 42 and has its maximum diameter in FIG. 1.

The drive belt 40 is in this embodiment also substantially thicker than the coiling band 24, so that the coil 43 of the drive belt 40 on the drive belt disc 42 also has a substantially larger radial dimension than the coil 25 of the coiling band 24 on the band reel 26, even on taking account of the different diameters of the band reel 26 and the drive belt disc.

Although not shown in FIG. 1 the drive shaft 28 is likewise rotatably journalled in the frame 12.

One sees that the coiling band 24 passes above the axle 29 of the drive shaft 28 to the band reel 26 whereas the drive belt 40 passes beneath the rotational axis of the drive shaft 28 and is taken up by the driving disc 38 from the drive disc 42.

It is now assumed that the planar articles 44 are delivered for winding up onto the winding core 16, and indeed preferably in an imbricated (overlapping) formation. The motor 30 is switched on and rotates in the direction of the arrow 54. The drive shaft 28 rotates in the direction of the arrow 56, whereby the coiling band 24 is now given out by the band reel 26 in the direction of the arrow 48 and, as a result of the spring tension, is wound with the planar articles onto the winding core. At the same time the drive belt 40 is wound up by the driving disc 38, i.e. it moves in the direction of the arrow 52.

In relation to the spring this means that the spring tension primarily brings about the winding up of the coiling band 24 and indeed through a continuous movement of the spring end 20 in the direction of the arrow 50 which is equivalent to a relaxation of the spring 18. During this movement the radially inner end 22 of the spring is rotated in the counter-clockwise sense, i.e. in the sense of retensioning the spring, via the drive train formed by the driving disc 38, the drive belt 40 and the drive belt disc 42.

The drawing of FIG. 1 reproduces the actual conditions in a practical embodiment of a coiling apparatus in accordance with the invention. At the start of the coiling up procedure of the coiling band onto the winding core 16, the coiling band 24 is unwound more quickly from the band reel 26 than the drive belt 40 is taken up by the driving disc 38 which is of smaller diameter. This is a result of the relatively larger diameter of the coil of the coiling band 24 on the band reel 26 in comparison to the diameter of the coil of the drive belt which is forming on the driving disc 38. Since the diameter of the coil of the coiling band 24 with the flexible articles 44 forming on the winding core 16 is at least approximately the same at the start of the winding up of the coiling band 24 onto the winding core 16 as the diameter of the coil of the drive belt 40 located on the drive belt disc 42, the first end 20 of the spring is moved more rapidly in the counter-clockwise direction than the other end 22 of the spring 18 can be retensioned. I.e. the spring tension initially reduces.

Since the drive belt 40 is thicker than the coiling band 24 the diameter of the coil of the drive belt 40 which forms on the driving disc 38 increases relatively quickly. In contrast the diameter of the coil of the coiling band 24 located on the band reel 26 only reduces relatively slowly. The rapid increase of the diameter of the coil of the drive belt 40 on the driving disc 38 leads to a corresponding reduction of the diameter of the coil 43 of the drive belt 40 present on the drive belt disc 42. In contrast the diameter of the coil forming on the winding core 16 and consisting of the planar articles 44 and the coiling band 24 increases relatively rapidly as a result of the thickness of the planar articles 44.

The effect of these diameter changes is that the speed at which the spring end 20 rotates in the counter-clockwise sense slows down, while the speed with which the spring end 22 is guided in the same direction increases, so that the tension of the spring thus increases as a whole after reaching a minimum value. As the increase of the spring tension corresponds to an increasing torque on the winding core 16, and as the diameter of the coil of the planar articles 44 with the coiling band 24 which forms on the winding core 16 likewise increases, the band tension which arises through this winding up work can remain approximately constant with the layout of the coiling apparatus shown in FIG. 1. As the drive motor 30 runs with an approximately constant speed of rotation, the drive shaft 28 is likewise driven with an at least substantially constant speed of rotation. Thus the coiling band is given out with at least substantially constant linear speed from the coil 25 on the band reel 26, since the coiling band is relatively thin so that the diameter of the coil 25 only reduces insubstantially. The coiling band 24 is thus wound with the planar articles 44 onto the winding core 16 with the same linear speed which corresponds with an increasing diameter of the coil present on the winding core 16 to a reduction of the speed of rotation of the coil.

The relationships in FIG. 1 have been specially selected for a coiling apparatus which winds up relatively thick planar articles such as newspapers or parts thereof. The possibility however exists, through different choice of the thicknesses of the coiling band 24 and of the drive belt 40, and also by different choice of the diameter of the band reel 26, of the driving disc 38, of the drive belt disc 42 and of the winding core 26, to vary the torque or speed characteristics during the winding up procedure within broad limits and to adapt them to the respectively prevailing circumstances.

On unwinding the coiling band 24 from the winding core 16 together with the planar articles 14 the relationships behave precisely inversely to the above described circumstances.

Since the spring is retensioned during the winding up of the coiling band 24 with the planar articles 44 onto the coil core 16, so that the spring tension increases at least during the later phase of the winding up procedure, energy must be delivered during this winding up phase to the coiling apparatus from the motor 30. In contrast, during a phase of the unwinding of the coiling band 24 with the planar articles 44 from the winding core 16, the spring tension reduces whereby the coil is rotated. The motor 30 serves in this connection principally to keep the linear speed of the coiling band at least substantially constant.

Figure 2A:
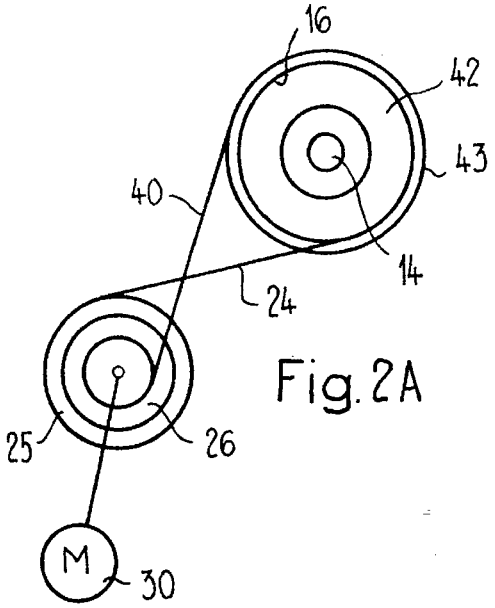
Figure 3A:
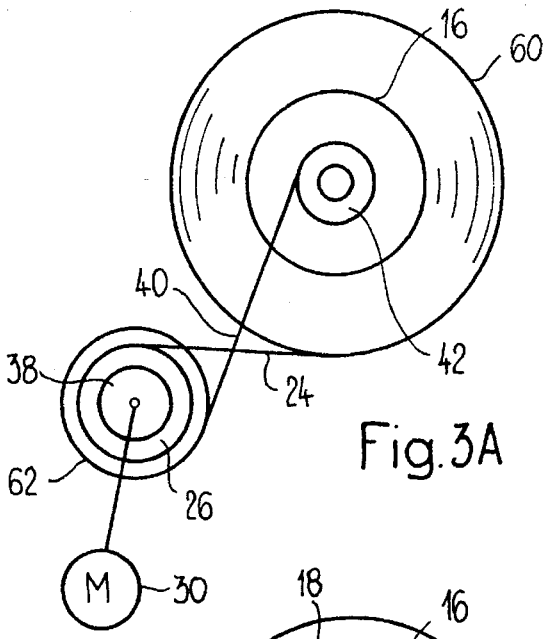
Figure 2B:
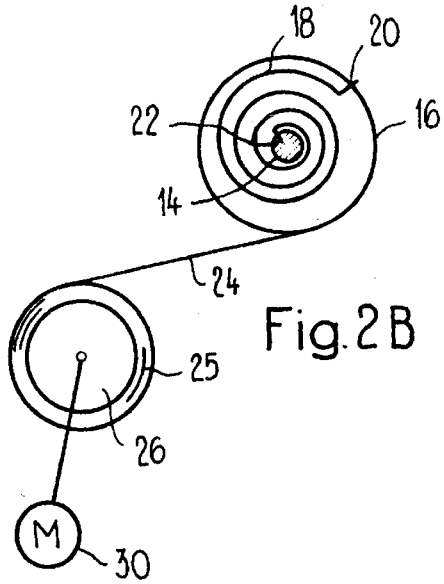
Figure 3B:
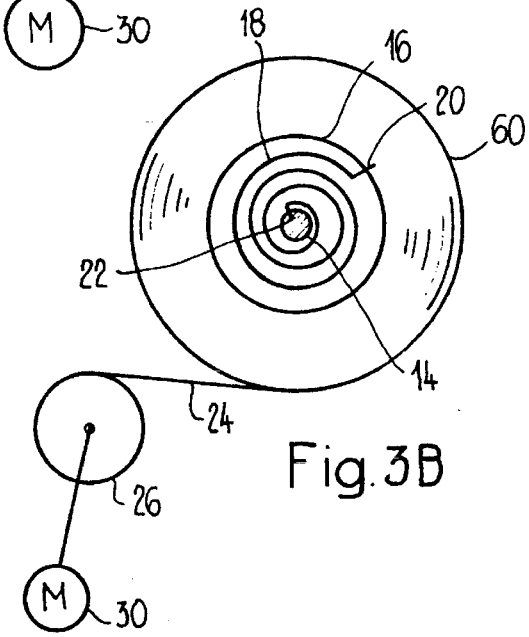
Figure 2C:
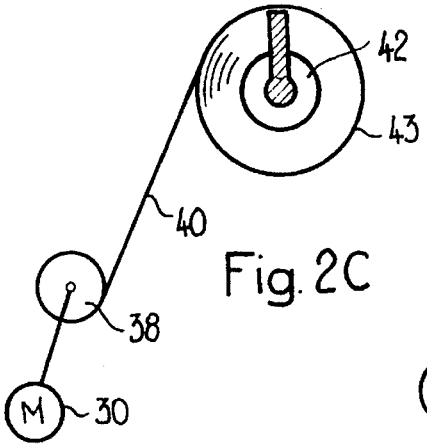
Figure 3C:
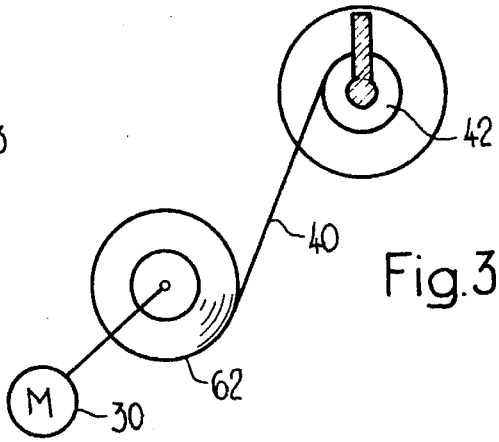

The diameter changes which have just been discussed are summarised for the sake of clarity in the FIGS. 2A to C and 3A to C. In this respect the FIG. 2A shows the initial state of FIG. 1 in which the coiling band 24 is fully wound onto the band reel 26 and there forms the coil 25. The drive belt is in contrast fully wound onto the drive belt disc 42 and there forms the coil 43. The FIGS. 2B and 2C show the relationships for the coiling band 24 and the drive belt 40 considered separately. FIG. 3A now shows the position at the end of the winding up procedure in which the coiling band 24 and the planar articles are wound up into a full coil 60 on the winding core 16. One sees that the coiling band 24 has been fully incorporated into the coil 60 and is only secured to the band reel 26. In contrast the drive belt 40 has been fully wound onto the driving disc 38, in the form of the coil 62, and is only just secured by its other end to the drive belt disc 42. The FIGS. 3B and 3C show the situation for the coiling band (FIG. 3B) and for the drive belt (FIG. 3C), each drawn separately.

Figure 4:
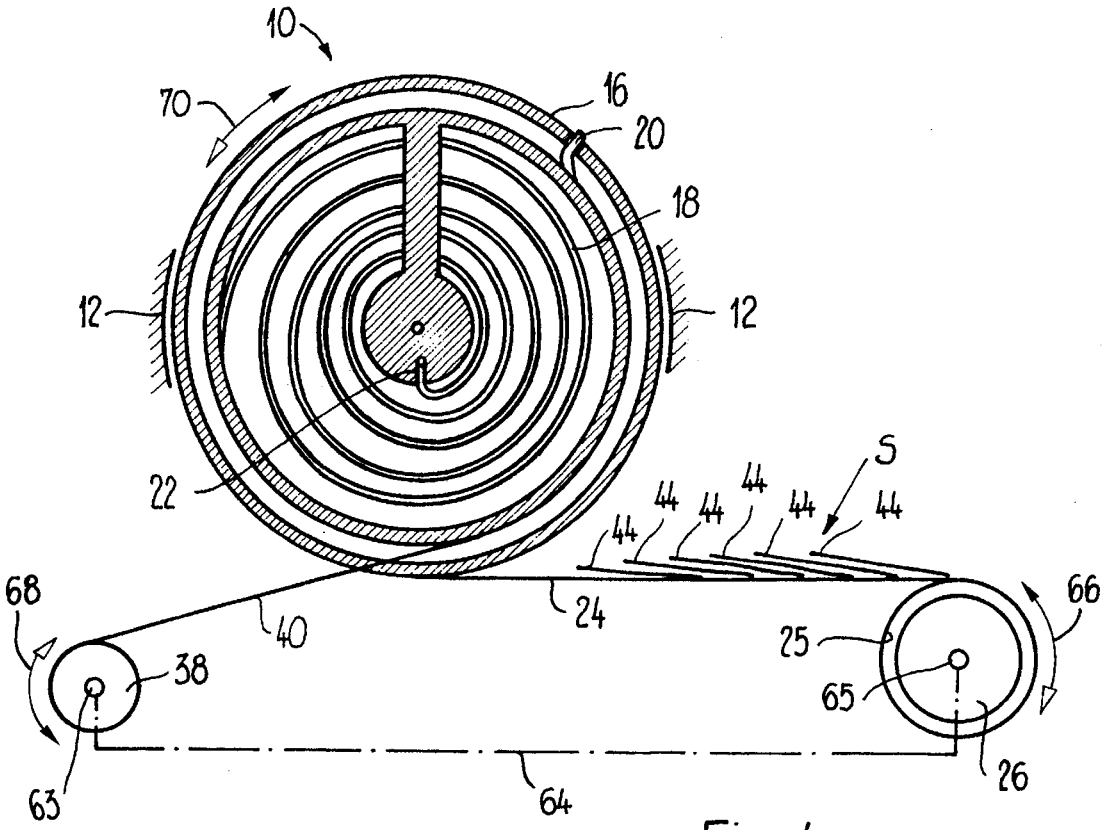

FIG. 4 shows an embodiment in which the driving disc 38 and the band reel 26 are arranged on different drive shafts 63 and 65 respectively which are however rotatably coupled to one another by a common drive as indicated by the broken line 64. The double arrows 66 and 68 show that both the band reel 26 and also the driving disc 38 are rotatable in both directions of rotation, with the band reel and the driving disc 38 both rotating in the same direction of rotation, which however changes depending on whether the coiling band 24 is being wound up onto the band reel or is being given out from the latter. FIG. 4 shows moreover an overlapping flow S consisting of several planar articles 44 arranged above one another in tile-like manner, such as printed products and the like. The double arrow 70 moreover shows that the winding core 16 always rotates in the opposite direction to the band reel 26 and the driving disc 38.

Figure 5:
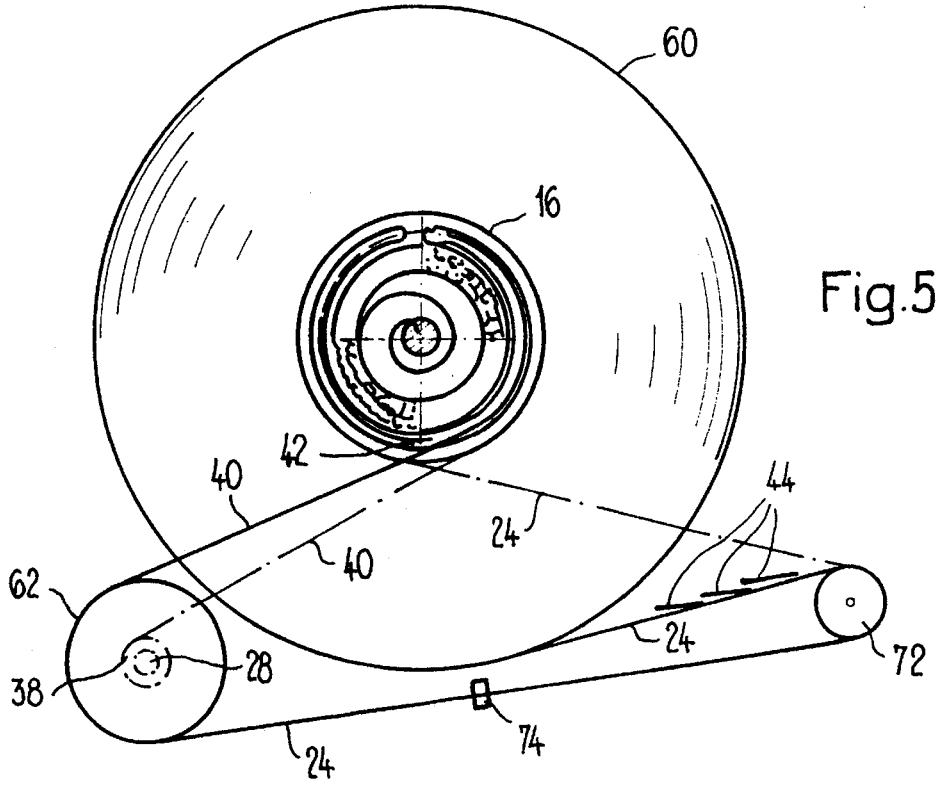

The FIG. 5 now shows again a modified embodiment of the coiling apparatus of FIG. 1. The band reel 26 cannot be seen in this figure because it sits behind the driving disc 38 with the coil 62 on the same drive shaft 28. In FIG. 5 the coiling band 24 is not guided directly from the band reel 26 to the winding core, or to the coil 60 which is forming on the latter, but rather indirectly via a deflection roller 72. In this arrangement a band guide 74 serves to align the coiling band between the band reel 26 and the deflection roller 72. The band guide 74 can for example consist of two freely rotatable cylinders which are arranged with their axes perpendicular to the plane of the coiling band on both sides of the run of the coiling band 24 between the band reel 26 and the deflection roller 72. The position of the coiling band 24 with the fully wound winding core 16 is shown in continuous lines in FIG. 5. In contrast the chain-dotted line extending between the winding core 16 and the deflection roller 72 show the starting position of the coiling band 24, i.e. directly before the coiling band 24 is wound onto the winding core 16 with the planar articles 44. At the left hand side of the rotational axis of the winding core 16 there is located the driving disc 38 for the drive belt 40 which is fully wound up into a coil 62 on the driving disc 38. The chain-dotted line which extends from the driving disc 38 to the coil 43 on the drive belt disc 42 shows the initial position of the drive belt 40, i.e. before it has been wound onto the driving disc 38.

Figure 7:
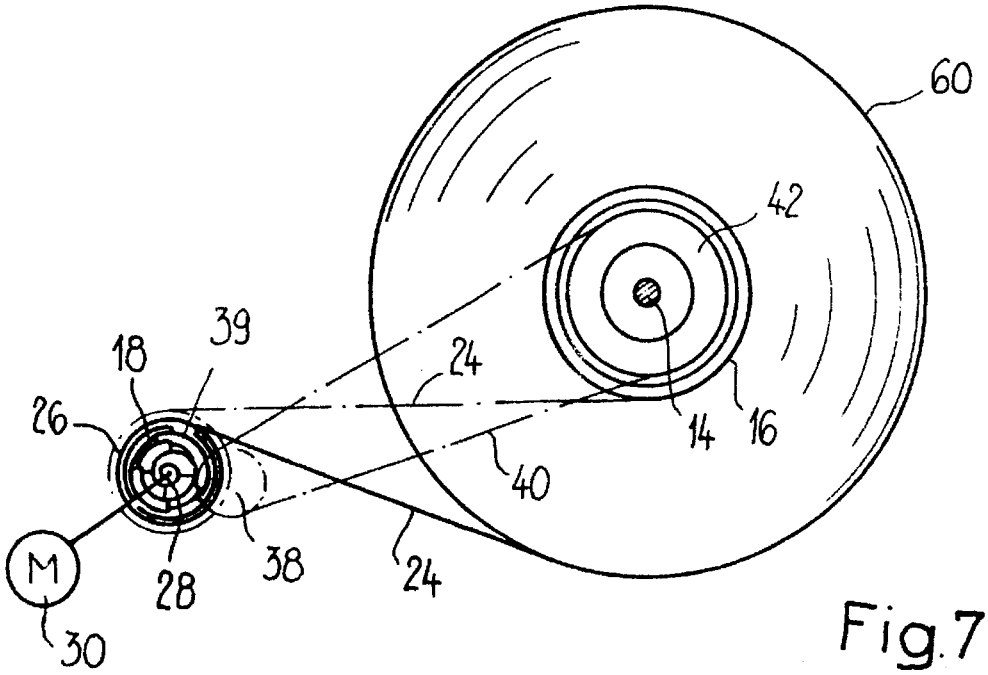
Figure 6:
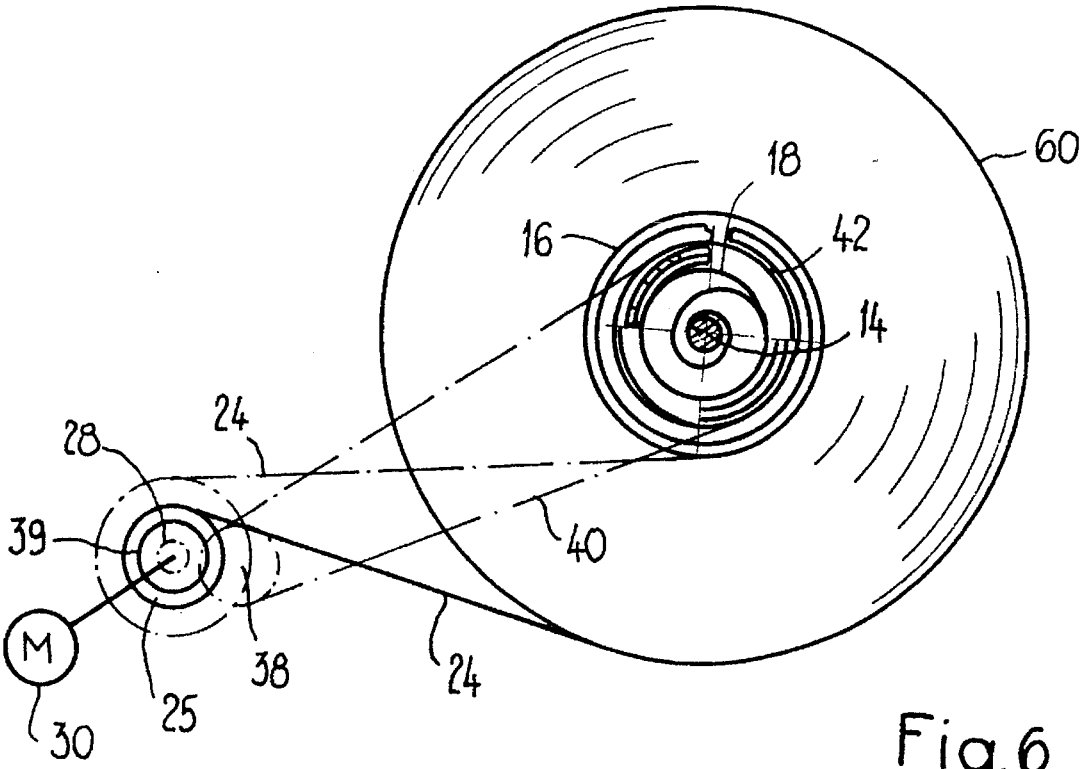

FIGS. 6 and 7 now show modified embodiments which, instead of operating with a drive train which includes a drive belt which can be wound up, operates with a drive train having a recirculating drive belt 40 in the form of a toothed belt or a chain.

Since in the arrangement shown in FIG. 6 the drive belt disc 42 must be rotated by the recirculating drive belt 40 in the counter-clockwise direction during winding up of the coiling band 24, it is necessary to provide for a reversal of the direction of rotation in the drive train. This takes place by means of a spur gear 39 which meshes with a further spur gear (not shown) which is secured to the driving disc 38 coaxial to the latter. As can be seen the toothed belt 40 leads from the driving disc 38, which is rotatable on a rotary axle parallel to the drive shaft 28, to the drive belt disc 42 on the rotatable shaft 14. The coiling band 24 shown as a chain-dotted line represents the initial situation at the start of the winding up procedure onto the winding core 16, whereas the solid line illustration of the coiling band 24 shows the position after the coiling band 24 with the overlapping formation of articles has been fully wound up onto the winding core 16 to form the coil 60.

In the previous embodiments, the speed of rotation of the rotary axle 14 and thus the retensioning speed of the spring end 22 changes in the course of operation. This is a result of the changing diameter of the coil of the drive belt 40 which forms on the driving disc 38 and of the reducing diameter of the coil of the drive belt 40 on the drive belt disc 42. In contrast, in the embodiment of FIG. 6 the speed of rotation of the rotary axle 14 remains the same or corresponds to the speed of rotation of the motor 30 multiplied by the transmission ratio of the drive train consisting of the spur gear 39, the spur gear (not shown) secured to the driving disc 38 and also of the driving disc, the toothed belt 40, the drive belt disc 42 and the shaft 14.

FIG. 7 shows an interesting variant in which the spiral spring 18 is arranged outside of the winding core. In the embodiment of FIG. 7 the motor 30 drives the drive shaft 28. The band reel 26 sits fixedly on the drive shaft 28. The spiral spring 18 is then arranged between the drive shaft 28 and the one spur gear 39 of the drive train which is formed here similarly to the drive train of the embodiment of FIG. 6, with the exception that the spur gear 39 is not fixedly connected to the drive shaft 28 but is rather freely rotatably arranged on the latter.

This variant is the same from the point of view of operation as the variants described in the preceding figures, i.e. the spiral spring 28 is built into the drive train 39, 38, 40, 42, 40 from the motor to the winding core. Here the spur gear 39 also serves for the change of the direction of rotation, so that during winding up of the coiling band 24 onto the winding core 16 the drive belt disc 42 likewise rotates in the counter-clockwise sense. In this example the drive belt disc 42 is rotationally fixedly connected to the winding core 16.

The accommodation of the spiral spring 17 can for example take place in such a way that the band reel 26 is formed as a drum and the spiral spring 18 is arranged inside the drum, with the one spring end being connected to the drum and the other spring end being connected to the spur gear 39 which is rotatably arranged on the drive shaft 28 coaxial to the drum.

Other variants of the FIG. 7 embodiment are also conceivable. For example there is a variant which operates in a corresponding manner and in which the spring 18 is arranged between the drive shaft 28 and the band reel 26. In this case the motor 30 drives the band reel 26. Here, as in the first described variant of FIG. 7, the spring is also arranged in the drive train which extends from the motor up to the winding core.

A third variant operates in accordance with a different principle from that of the two previously described variants of FIG. 7. In this third variant the motor 30 drives the drive shaft 28 on which the spur gear 39 of the drive train is fixedly seated. The spring 18 is then arranged between the drive shaft 28 and the band reel 26. This signifies that the winding core is fixedly coupled to the motor 30 while the band reel 26 is driven from the motor via the spring. This variant is indeed entirely practicable, does however have the disadvantage that if the circumferential speed of the coil is to remain constant the speed of rotation of the motor must be regulated, which is not the case with the other embodiments. The drive speed of the coiling band is no longer so accurately controllable.

The variant of FIG. 7 can also be developed further in order to use a drive train with a drive belt which can be wound up in accordance with the embodiment of FIG. 1. It would also be conceivable to accommodate the spiral spring at other positions within the drive train.

Figure 8:
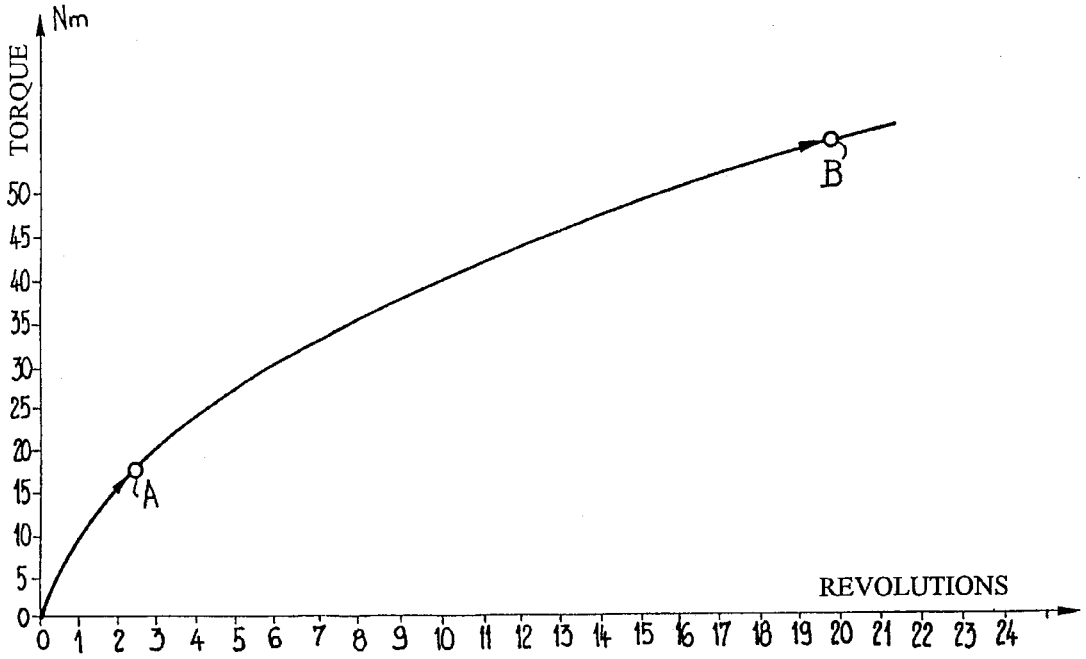

FIG. 8 now shows a first possible torque characteristic during a winding up procedure using a coiling apparatus. In this embodiment the spiral spring is pretensioned over 2½ turns up to the point A during the assembly of the whole apparatus. This permanent pretension can for example be achieved in that, with the winding core 16 being held stationary, the rotary shaft 14 is turned through 2½ turns in the sense of increasing the tension of the spring before the drive belt 40 is secured to the driving disc 38. Alternatively the rotary shaft 14 can be held stationary and the spring 18 can be tensioned by rotation of the winding core 16 through 2½ turns before the coiling band 24 is connected to the winding core 16.

In the plot of the torque shown in FIG. 8, by appropriate choice of the diameter of the driving disc 38 and of the drive belt disc 42 in comparison to the band reel 26, the rotary shaft 14 is always driven via the drive belt 40, with a higher speed of rotation than the instantaneous speed of rotation of the winding core 16 predetermined for the band reel 26 and the coiling band 24, so that the spring tension continuously rises from point A to reach the point B. Point B represents the maximum number of turns with the winding core 16 which is possible with the specific layout of the spring 18, i.e. the spring 18 has been wound up by a total of 17½ turns from point A to point B during the winding up of the coiling band with the flexible planar articles.

Figure 9:
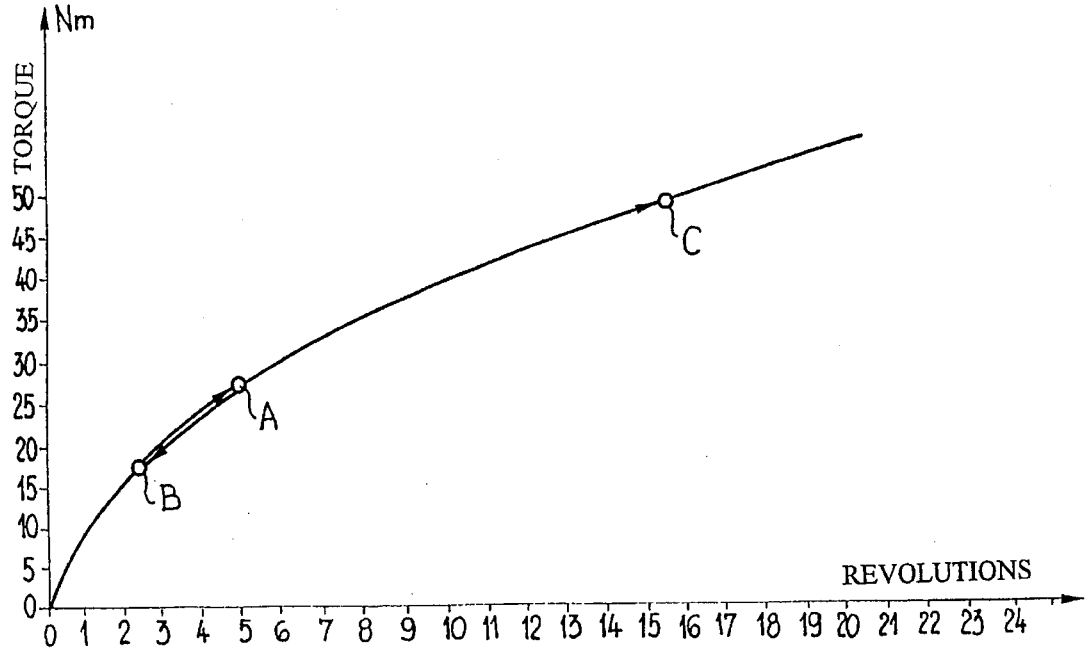

FIG. 9 shows a modified embodiment which shows the torque characteristic in the embodiment of FIG. 1. Here one operates with a higher initial tension of the spring 18 in that the spring is pretensioned by 5 turns until it reaches the point A, and indeed in the same way and means as described in connection with FIG. 8.

Now the diameter relationships of the driving disc 38 and of the drive belt disc 42 in comparison to the diameter of the band reel 26 and the winding core 16 have been selected here in accordance with FIG. 1 in such a way that at the start of the winding procedure the rotary speed of the spring end 20 is greater than that of the spring end 22, so that the spring tension relaxes and the torque exerted by the spring 18 on the winding core sinks up to the point B. At point B the rotary speed of the spring end 20 now equals the rotary speed of the spring end 22 and, during further winding up of the coiling band 24 with the flexible planar articles 44, the speed of rotation of the spring end 22 increases in relation to the speed of rotation of the spring end 20. Thus the torque now increases again up to the point C where the coiling up procedure has terminated. This point C is also determined by the layout of the spring, i.e. the maximum permissible number of winding up turns of the spring 18.

Through corresponding choice of the transmission ratios the torque characteristics illustrated in FIGS. 8 and 9 can be achieved with the embodiments of FIGS. 6 and 7.

The speed of the coiling band is approximately the same as the speed of supply of the planar articles which are to be wound up. The speed of supply can also vary.

We claim:

1. Coiling apparatus (10) for flexible planar articles (44), the apparatus comprising a frame (12), a winding core (16) which is rotatably journalled in said frame (12), a rotatably driveable drive shaft (28) for driving said winding core (16), means (30) for driving said drive shaft (28); a band reel (26) rotationally fixedly arranged on said drive shaft (28); a coiling band (24) extending from said band reel (26) to said winding core (16) and being connected to the latter, said coiling band (24) directs the flexible planar articles (44) substantially tangentially to the winding core and is wound together with the planar articles onto the winding core; a drive train (38, 40, 42, 14) arranged between said drive shaft and said winding core (16) for transmitting the rotational movement of said drive shaft (28) to said winding core (16); said drive train including a spring (18) having first and second ends (20, 22), said first and second ends being movable relative to one another during rotation of the winding core (16) and the band reel (26).

2. Coiling apparatus in accordance with claim 1, wherein said spring (18) is in the form of a spiral spring.

3. Coiling apparatus in accordance with claim l or claim 2, wherein a motor (30) is provided for rotatably driving said drive shaft (28), said drive train includes a driving disc (38) and wherein said drive shaft extends parallel to the rotational axis (13) of the winding core (16) alongside the latter and carries and drives both said band reel (26) for the winding up and unwinding of the coiling band (24) and also said driving disc (38).

4. Coiling apparatus in accordance with claim 3, wherein said drive train (28, 40, 42, 14) includes a rotatable shaft (14) which is arranged coaxial and concentric to the winding core (16) and is rotatable relative to the winding core, and wherein said first end (20) of said spring (18) is connected to the winding core (16) and said second end (22) of the spring is secured to said rotatable shaft (14).

5. Coiling apparatus in accordance with claim 4, wherein said winding core (16) includes a drum, with said spring (18) being located inside said drum.

6. Coiling apparatus in accordance with claim 5, wherein said drum is rotatably journalled on said rotatable shaft (14).

7. Coiling apparatus in accordance with claim 5, wherein said drive train includes a drive belt (40) having first and second ends which is secured at its one end to said driving disc (38) and at its other end to a a drive belt disc (42) and can be unwound from said drive belt disc (42) while being wound onto said driving disc (38) and vice-versa, with the arrangement being so devised that on winding up of the coiling band (24) onto said band reel (26) said drive belt (40) is unwound from said driving disc (38) and vice-versa.

8. Coiling apparatus in accordance with claim 7, wherein said drive belt disc (42) is directly and rotationally fixedly coupled to the rotatable shaft (14).

9. Coiling apparatus in accordance with claim 8, wherein the combination further includes a deflection roller (72), and said coiling band (24) which comes from said winding core (16) is led via said deflection roller (72) to said band reel (26) while said drive belt (40) extends directly from said drive belt disc (42) to said driving disc (38).

10. Coiling apparatus in accordance with claim 9, wherein the combination further includes a band guide (74), said band guide (74) acts on said coiling band (24) in the region of a run of said coiling band extending between said band reel (26) and said deflection roller (72) in order to ensure the alignment of said coiling band (24).

11. Coiling apparatus in accordance with claim 4, wherein said drive train (38, 40, 42, 14) includes a drive disc (42) coupled to said rotatable shaft and a recirculating transmission device in the form of a chain (40), said recirculating transmission device being adapted to drive said drive disc (42).

12. Coiling apparatus in accordance with claim 11, wherein said drive train (39, 38, 40, 42) includes a spur gear (39) and a driving disc (38), said spur gear (39) is driven by said drive shaft which functions to transmit rotation of the drive shaft (28) to a driving disc (38) which moves said recirculating transmission device.

13. Coiling apparatus in accordance with claim 4, wherein said drive train (38, 40, 42, 14) includes a drive disc (42) coupled to said rotatable shaft and a recirculating transmission device in the form of a toothed belt, said recirculating transmission device being adapted to drive said drive disc (42).

14. Coiling apparatus in accordance with claim 4, wherein said drive train (38, 40, 42, 14) includes a drive disc (42) coupled to said rotatable shaft and a recirculating transmission device in the form of a V-belt, said recirculating transmission device being adapted to drive said drive disc (42).

15. Coiling apparatus in accordance with claim 1, wherein the combination further includes a spur gear (39) rotatably arranged on said drive shaft (28) and wherein said spring (18) is arranged between said drive shaft (28) and said spur gear (39).

16. Coiling apparatus in accordance with claim 1, wherein said drive train further includes a driving disc (38) and said spring is arranged between said drive shaft and said driving disc (38) of said drive train, said drive train being rotatably arranged on the drive shaft (28).

17. Coiling apparatus in accordance with claim 1, wherein said drive train (38, 40, 42, 14) includes a driving disc (38) a drive belt (40) having first and second ends, and a drive belt disc (42), wherein said drive belt (40) is secured at its one end to said drive belt disc (42) and at its other and to said driving disc (38), and can be wound off from the drive belt disc (42) and onto said driving disc (38) and vice-versa, wherein the arrangement is such that during winding of said coiling band (24) onto said band reel (26) said drive belt (40) is wound off from said driving disc (38) and vice-versa.

18. Coiling apparatus in accordance with claim 17, wherein said drive belt disc (42) is directly and rotationally fixedly coupled to said winding core (16).

19. Coiling apparatus in accordance with claim 1, wherein said drive train has a spur gear (39), a further spur gear, a recirculating transmission device that includes a driving disc (38), said spur gear (39) being rotationally fixedly mounted on said drive shaft (28) and drives, via said further spur gear, said driving disc (38) of said recirculating transmission device, said recirculating transmission device serves to rotate a drive belt disc (42) connected to said winding core (16), and thus to drive the winding core (16).

20. Coiling apparatus in accordance with claim 1, wherein said spring (18) is in the form of a drive spring.

21. Coiling apparatus in accordance with claim 1, wherein said spring (18) is in the form of a torsion spring having a plurality of windings.

22. Coiling apparatus (10) for flexible planar articles (44), the apparatus comprising a frame (12), a winding core (16) rotatably journalled in said frame (12), said apparatus having winding up and winding off processes that functions to wind up and wind off said flexible planar articles on said winding core, said winding core being under a first torque of a first magnitude prior to initiation of the winding up process, a drive shaft (28) for driving said winding core (16), a band reel (26) coupled to said drive shaft (28); a coiling band (24) which directs the flexible planar articles (44) substantially tangentially to said winding core (16) and which comes from said band reel (26) and can be wound together with the planar articles onto the winding core, wherein said drive shaft (28) is coupled to said winding core (16) through said band reel (26) and said coiling band (24) and through a drive train (38, 40, 42, 14); wherein said coiling band (24) is tensioned both prior to and also during the winding up onto said winding core (16) and during the winding off from said winding core (16) and thus exerts a first torque on said winding core (16); wherein said drive shaft exerts via said drive train (38, 40, 42, 14) a second torque of a second magnitude on said winding core (16) opposed to said first torque; and wherein a spring (18) is provided which modifies the relative magnitudes of the first and second torques, during the winding up and winding off of said coiling band (24).

23. Coiling apparatus (10) for flexible planar articles (44), the apparatus comprising a frame (12), a winding core (16) which is rotatably journalled in said frame (12), a rotatable drive shaft (28) for driving said winding core (16), a driveable band reel (26) freely arranged on said drive shaft (28) for rotational movement; means for driving said band reel (26), a coiling band (24) extending from said band reel (26) to said winding core (16) and being connected to the latter, said coiling band (24) directs the flexible planar articles (44) substantially tangentially to the winding core and is wound together with the planar articles onto the winding core; a drive train (38, 40, 42, 14) arranged between said drive shaft (28) and said winding core (16) for transmitting the rotational movement of said drive shaft (28) to said winding core (16), a spring (18) having first and second ends (20, 22) which are movable relative to one another during rotation of the winding core (16) and the band reel (26), said spring (18) being arranged between said band reel (26) and said drive shaft (28).

24. Coiling apparatus (10) for flexible planar articles (44), the apparatus comprising a frame (12), a winding core (16) which is rotatably journalled in said frame (12), a rotatably driveable drive shaft (28) for driving said winding core (16), means for driving said drive shaft (28), a band reel (26) freely arranged on said drive shaft (28) for rotational movement, a coiling band (24) extending from said band reel (26) to said winding core (16) and being connected to the latter, said coiling band (24) directs the flexible planar articles (44) substantially tangentially to the winding core and is wound together with the planar articles onto the winding core; a drive train (38, 40, 42 14) arranged between said drive shaft and said winding core (16) for transmitting the rotational movement of said drive shaft (28) to said winding core (16), a spring (18) having first and second ends (20, 22) which are movable relative to one another during rotation of the winding core (16) and the band reel (26), said spring (18) being arranged between said drive shaft (28) and said band reel (26).

25. Coiling apparatus in accordance with claim 24, wherein said band reel (26) is arranged coaxial to said drive shaft (28) and is rotatable relative to the latter.

26. Coiling apparatus (10) for flexible planar articles (44), the apparatus comprising a frame (12), a winding core (16) which is rotatably journalled in said frame (12), a first rotatably driveable drive shaft (63) for driving said winding core (16), a second rotatably driveable drive shaft (65), a band reel (26) rotationally fixedly arranged on said second drive shaft (65); means for conjointly driving said first and second drive shafts (63, 65), a coiling band (24) extending from said band reel (26) to said winding core (16), and being connected to the latter, said coiling band (24) directs the flexible planar articles (44) substantially tangentially to the winding core and is wound together with the planar articles onto the winding core, a drive train (38, 40, 42, 14) arranged between the first drive shaft and said winding core (16) for transmitting the rotational movement of said first drive shaft (63) to said winding core (16); a spring (18) having first and second ends (20, 22) which are movable relative to one another during rotation of the winding core (16) and the band reel (26), said spring (18) being arranged in said drive train (38, 40, 42, 14) between said first drive shaft (28) and said winding core (16).

27. Coiling apparatus in accordance with claim 26, wherein said spring (18) is in the form of a spiral spring.

28. Coiling apparatus in accordance with claim 27, wherein said drive train (28, 40, 42, 14) includes a rotatable shaft (14) which is arranged coaxial and concentric to the winding core (16) and is rotatable relative thereto;

said first end (20) of said spring (18) is connected to the winding core (16) and said second end (22) of the spring is secured to said rotatable shaft (14);

said winding core (16) includes a drum, with said spring (18) being located inside said drum;

said drive train includes a drive belt (40) having first and second ends which is secured at its first end to a driving disc (38) and at its second end to a drive belt disc (42) and can be unwound from said drive belt disc (42) while being wound onto said driving disc (38) and vice-versa, with the arrangement being so devised that on winding up of the coiling band (24) onto said band reel (26) said drive belt (40) is unwound from said driving disc (38) and vice-versa.

29. Coiling apparatus in accordance with claim 28, wherein said drive belt disc (42) is directly and rotationally fixedly coupled to the rotatable shaft (14).

30. Coiling apparatus in accordance with claim 27, wherein said drive train (28, 40, 42, 14) includes:

a rotatable shaft (14) arranged coaxial and concentric to said winding core (16) and is rotatable relative thereto, said first end (20) of said spring (18) is connected to the winding core (16) and said second end (22) of the spring is secured to said rotatable shaft (14);

a drive disc (42) is coupled to said rotatable shaft; and a recirculating transmission device in the form of a chain (40) functions to drive said drive disc (42).

31. Coiling apparatus in accordance with claim 30, wherein said drive train (39, 38, 40, 42) includes a spur gear (39) and a driving disc (38), said spur gear (39) is driven by said first drive shaft which transmits the rotation of the first drive shaft (28) to said driving disc (38) which transmits motion to said recirculating transmission device.

32. Coiling apparatus in accordance with claim 26, wherein said spring (18) is in the form of a drive spring.

33. Coiling apparatus in accordance with claim 32, wherein said drive train (28, 40, 42, 14) includes a rotatable shaft (14) which is arranged coaxial and concentric to the winding core (16) and is rotatable relative thereto;

said first end (20) of said spring (18) is connected to the winding core (16) and said second end (22) of the spring is secured to said rotatable shaft (14);

said winding core (16) includes a drum, with said spring (18) being located inside said drum;

said drive train includes a drive belt (40) having first and second ends which is secured at its first end to a driving disc (38) and at its second end to a drive belt disc (42) and can be unwound from said drive belt disc (42) while being wound onto said driving disc (38) and vice-versa, with the arrangement being so devised that on winding up of the coiling band (24) onto said band reel (26) said drive belt (40) is unwound from said driving disc (38) and vice-versa.

34. Coiling apparatus in accordance with claim 33, wherein said drive belt disc (42) is directly and rotationally fixedly coupled to the rotatable shaft (14).

35. Coiling apparatus in accordance with claim 32, wherein said drive train (28, 40, 42, 14) includes:

a rotatable shaft (14) arranged coaxial and concentric to said winding core (16) and is rotatable relative thereto, said first end (20) of said spring (18) is connected to the winding core (16) and said second end (22) of the spring is secured to said rotatable shaft (14);

a drive disc (42) is coupled to said rotatable shaft; and a recirculating transmission device in the form of a toothed belt functions to drive said drive disc (42).

36. Coiling apparatus in accordance with claim 35, wherein said drive train (39, 38, 40, 42) includes a spur gear (39) and a driving disc (38), said spur gear (39) is driven by said first drive shaft which transmits the rotation of the first drive shaft (28) to said driving disc (38) which transmits motion to said recirculating transmission device.

37. Coiling apparatus in accordance with claim 26, wherein said spring (18) is in the form of a torsion spring having a plurality of windings.

38. Coiling apparatus in accordance with claim 37, wherein said drive train (28, 40, 42, 14) includes a rotatable shaft (14) which is arranged coaxial and concentric to the winding core (16) and is rotatable relative thereto;

said first end (20) of said spring (18) is connected to the winding core (16) and said second end (22) of the spring is secured to said rotatable shaft (14);

said winding core (16) includes a drum, with said spring (18) being located inside said drum;

said drive train includes a drive belt (40) having first and second ends which is secured at its first end to a driving disc (38) and at its second end to a drive belt disc (42) and can be unwound from said drive belt disc (42) while being wound onto said driving disc (38) and vice-versa, with the arrangement being so devised that on winding up of the coiling band (24) onto said band reel (26) said drive belt (40) is unwound from said driving disc (38) and vice-versa.

39. Coiling apparatus in accordance with claim 38, wherein said drive belt disc (42) is directly and rotationally fixedly coupled to the rotatable shaft (14).

40. Coiling apparatus in accordance with claim 37, wherein said drive train (28, 40, 42, 14) includes:

a rotatable shaft (14) arranged coaxial and concentric to said winding core (16) and is rotatable relative thereto, said first end (20) of said spring (18) is connected to the winding core (16) and said second end (22) of the spring is secured to said rotatable shaft (14);

a drive disc (42) is coupled to said rotatable shaft; and a recirculating transmission device in the form of a V-belt functions to drive said drive disc (42).

41. Coiling apparatus in accordance with claim 40, wherein said drive train (39, 38, 40, 42) includes a spur gear (39) and a driving disc (38), said spur gear (39) is driven by said first drive shaft which transmits the rotation of the first drive shaft (28) to said driving disc (38) which transmits motion to said recirculating transmission device.

* * * * *

UNITED STATES PATENT AND TRADEMARK OFFICE

CERTIFICATE OF CORRECTION

PATENT NO. : 5,622,027

DATED : April 22, 1997

INVENTOR(S) : Samuel Staub et al.

It is certified that error appears in the above-indentified patent and that said Letters Patent is hereby corrected as shown below:

In the Claims

In claim 17, line 5, replace the second occurrence of "and" with --end--.

In claim 24, line 12, immediately after "42" insert --,--.

Signed and Sealed this

Sixth Day of July, 1999

*Attest:*

*Attesting Officer*

Q. TODD DICKINSON

*Acting Commissioner of Patents and Trademarks*